US006441567B1

(12) United States Patent
Meershoek

(10) Patent No.: US 6,441,567 B1
(45) Date of Patent: Aug. 27, 2002

(54) DISPLAY DEVICE COMPRISING A DEFLECTION UNIT AND A DEFLECTION UNIT FOR A DISPLAY DEVICE

(75) Inventor: Hans Meershoek, Peitou (TW)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/534,208

(22) Filed: Mar. 24, 2000

(30) Foreign Application Priority Data

Mar. 30, 1999 (EP) ..... 99200993

(51) Int. Cl.[7] ..... H01J 29/51; H01J 29/76
(52) U.S. Cl. ..... 315/368.28; 315/399
(58) Field of Search ..... 315/8, 85, 364, 315/368.25, 399, 307, 368.27, 368.28; 313/421, 423, 433

(56) References Cited

U.S. PATENT DOCUMENTS 5,705,899 A * 1/1998 Penninga et al. ..... 315/368.26
6,048,240 A * 4/2000 Damsteegt et al. ..... 445/3
6,084,490 A * 7/2000 Azzi et al. ..... 335/210
6,307,333 B1 * 10/2001 Sluyterman et al. ... 315/368.28

FOREIGN PATENT DOCUMENTS

FR 2259500 8/1975 ..... H04N/3/16

* cited by examiner

*Primary Examiner*—Don Wong
*Assistant Examiner*—Minh Din A

(57) ABSTRACT

A color display device comprising a cathode ray tube and a deflection unit. The display device includes a compensation coil arranged circumferentially around the display tube, for example on the deflection unit, and means to supply dc current to the coil for correcting a trapezoidal distortion in the raster displayed on the screen.

8 Claims, 6 Drawing Sheets

DISPLAY DEVICE COMPRISING A DEFLECTION UNIT AND A DEFLECTION UNIT FOR A DISPLAY DEVICE

The invention relates to a colour display device comprising a cathode ray tube, a means for generating at least one electron beam, a display screen and a deflection unit for generating deflection fields for deflecting electron beam(s) across the display screen.

The invention also relates to a deflection unit for a cathode ray tube. The earth's magnetic field or other ambient magnetic fields cause a distortion of the image displayed. The most prominent of these effects is commonly referred to as image rotation or frame rotation.

It has been found that the earth's magnetic field or indeed any other ambient magnetic field does not only cause a frame rotation but also other errors. A serious problem is given by the fact that apart from an image rotation also a shift of the picture in the horizontal direction as well as a trapezium distortion of the displayed image is caused by such fields. The trapezium distortion is one particular annoying. Customers want to use colour display devices for world wide application. Because of ever increasing demand on (reduction of) geometry distortions in the displayed image, rejects on geometry distortion are ever more increasing.

It is an object of the invention to provide a display device having an improved quality of the displayed image.

To this end, the display device in accordance with the invention is characterised in that the display device comprises a coil circumferentially arranged around the display device and the display device comprises means for directing an ac current through the coil, said accurrent having the same frequency as the vertical deflection current for generating a magnetic field for compensation of a trapezium shaped distortion of the displayed image.

The inventors have realised that the cause of the problem is the amplitude and direction of the vertical field component of the ambient field, usually the earth magnetic field, besides a shift in horizontal direction, it gives a trapezium distortion of the displayed image.

Because this vertical component is different in the North- and South hemisphere a difference in trapezium distortion occurs. In a 17" diagonal display device the difference is typical 1.6 mm, a clearly visible effect. Thus a display tube optimised for the Northern hemisphere will show clearly visible trapezium distortion when used in the Southern hemisphere. This effect leads ever more, given the ever more increasing demands on the image quality to rejection of the device. Several possibilities for solving this problem have been considered by the inventors:

- Optimise the deflection unit especially for the Southern hemisphere. This will, however effect convergence quality and lead to two different types of deflection units
- Use a magnetic 2-pole on the neck of the tube to compensate the ambient magnetic field. This would however seriously effect landing purity and require further adjustments.

These solutions therefore are far from simple solutions and cause other serious problems.

The display device in accordance with the invention provides a simple solution for the problem, which does not introduce substantial additional errors, which would then have to be compensated. It is remarked that the invention is aimed at providing a solution to a problem of trapezium distortion, said problem most commonly being caused by the earth's magnetic field or other ambient magnetic fields.

These are however, not the only possible causes for the occurrence of a trapezium distortion. The invention in its broadest scope can be used whatsoever the cause of the trapezium distortion might be, although certain preferred embodiments as described below are directed to solving problems specifically caused by the earth's magnetic field.

A coil which is circumferentially arranged is, when driven by an ac current of the proper frequency, capable of compensating the negative effect of the earth's magnetic field (or any other ambient magnetic field) of trapezium distortion. Supplying the coil with a current having the same frequency as the vertical deflection current enables a field of the right frequency to be formed. It is surprising that although the trapezoidal distortion is usually formed by a static magnetic field component, the compensation is performed by generating an ac magnetic field. The field generated by the circumferentially arranged coil is of a relatively simple shape, and does not or only to a small degree introduce (higher order) field components having detrimental side effects on other image properties. Preferably, the compensation coil is circumferentially arranged around the display device at, near or beyond the end of the deflection unit facing the display screen. This position and arrangement of the coil (namely at a position where the electron beams have already undergone at least a substantial deflection) will cause the coil to generate a compensating field which will counter-effect the trapezium distortion most effectively but has negligible effects on other image properties, such as landing or convergence.

The coil could be approximately circular or show slight deviations from a circular shape (for instance ellipsoidal or rectangular with rounded comers).

The coil is preferably mounted on the deflection unit to simplify the design. The coil could however also be a stand-alone coil on the cone of the tube.

The coil may be housed in a housing to provide protection and increase ease of installment.

In a first embodiment of the invention the display device is provided with means to supply also a dc current to the coil.

In this embodiment the coil generates both a dc field, by which rotation of the image may be (partly) counteracted, as well as an ac field by which a trapezium distortion of the image may be counteracted.

Such an embodiment may comprise a single coil for both rotation and trapezium distortion compensation, or a coil comprising sub-coils in series as far as dc current is concerned, a first sub-coil being supplied in operation with a dc and an ac current, a further sub-coil with an dc current. Use of a single coil has the advantage that only one coil is to be used, use of sub-coils has the advantage that the sub-coils and more in particular the current through the sub-coils and can be optimised to reduce power consumption.

Preferably the coil is arranged in series with the vertical deflection coils. This provides a simple design. The added impedance to the vertical deflection coils is neglectable small compared to that of the vertical coils.

Preferably the coil comprises 5–20 turns, when in series with the deflection unit.

The means for supplying dc current through the coil may be provided by the manufacturer so as to counteract a known effect (for instance when it is known that the device will be used in a particular region or country in the southern hemisphere) or it can be supplied with means for setting the dc current by the user (or seller of the device). Such means for setting may be provided with indication relating to the countries or other indications to help setting the dc current.

These and further aspects of the invention will be explained in greater detail by way of example and with reference to the accompanying drawings, in which FIG. 1 is a display device;

Figure 5A:
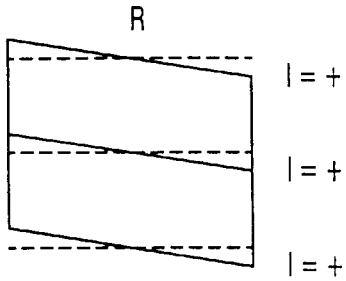
Figure 5B:
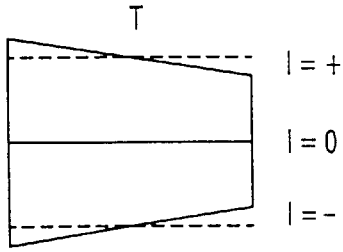
Figure 5C:
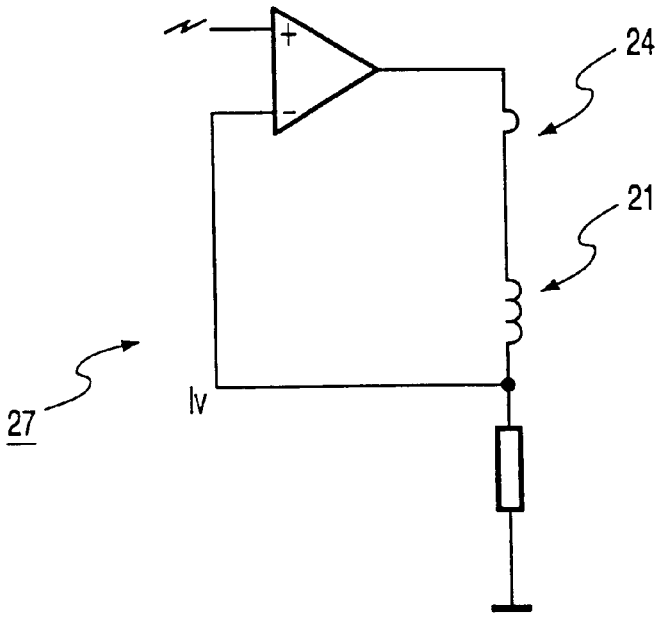
Figure 5D:
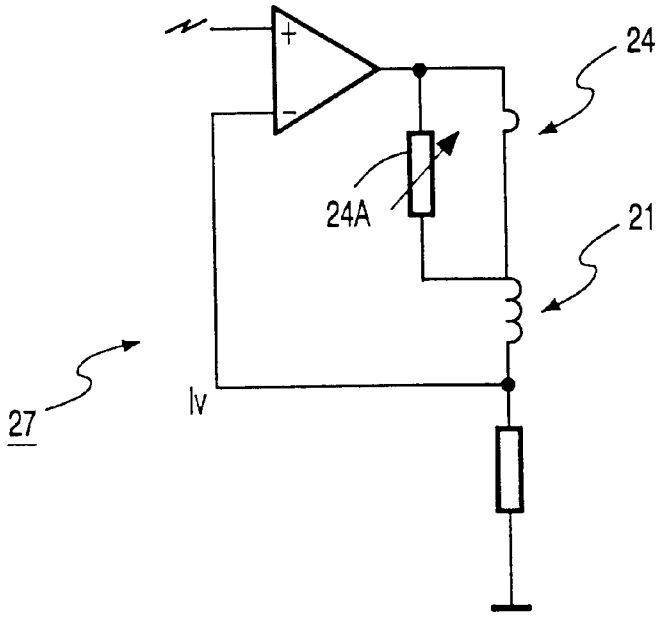
Figure 6:
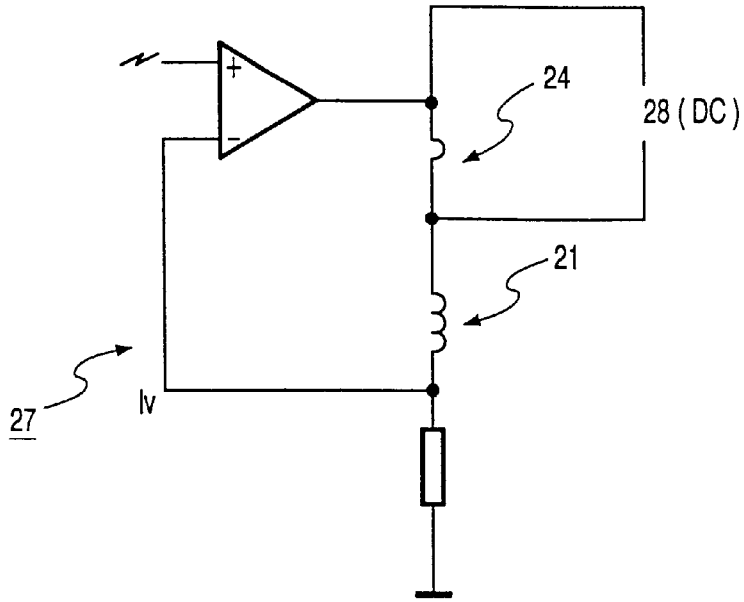
Figure 7:
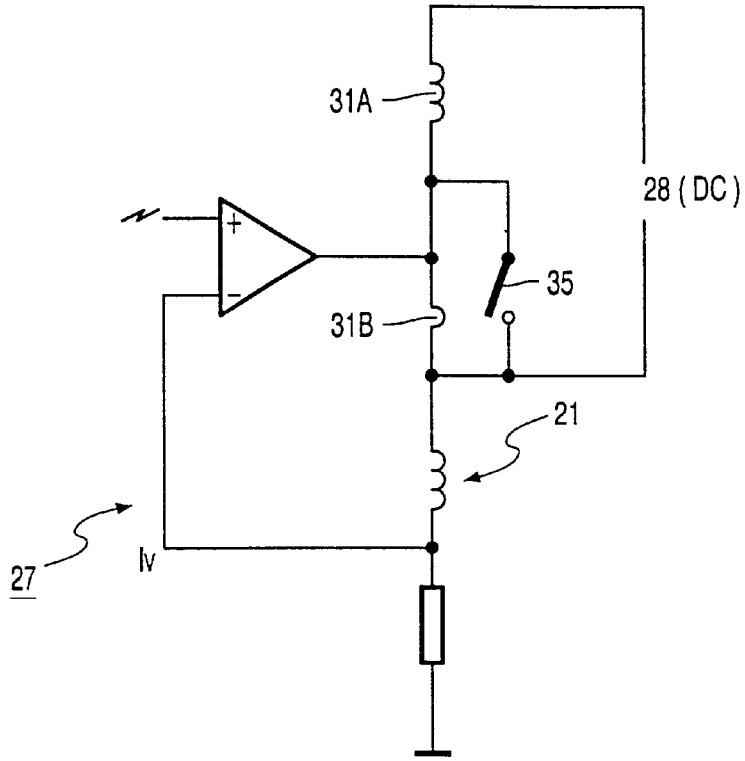

FIGS. 5A to 5D illustrate the different effect of the earth's magnetic field on the displayed image and the current through a coil circumferentially arranged around the display device to compensate these effects (FIGS. 5A and 5B) as well as schematically indicated an electrical circuit for embodiments of the invention (FIGS. 5C and 5D); and FIGS. 6 and 7 illustrate schematically two further embodiments of the invention.

The Figures are not drawn to scale. In general, like reference numerals refer to like parts.

Figure 1:
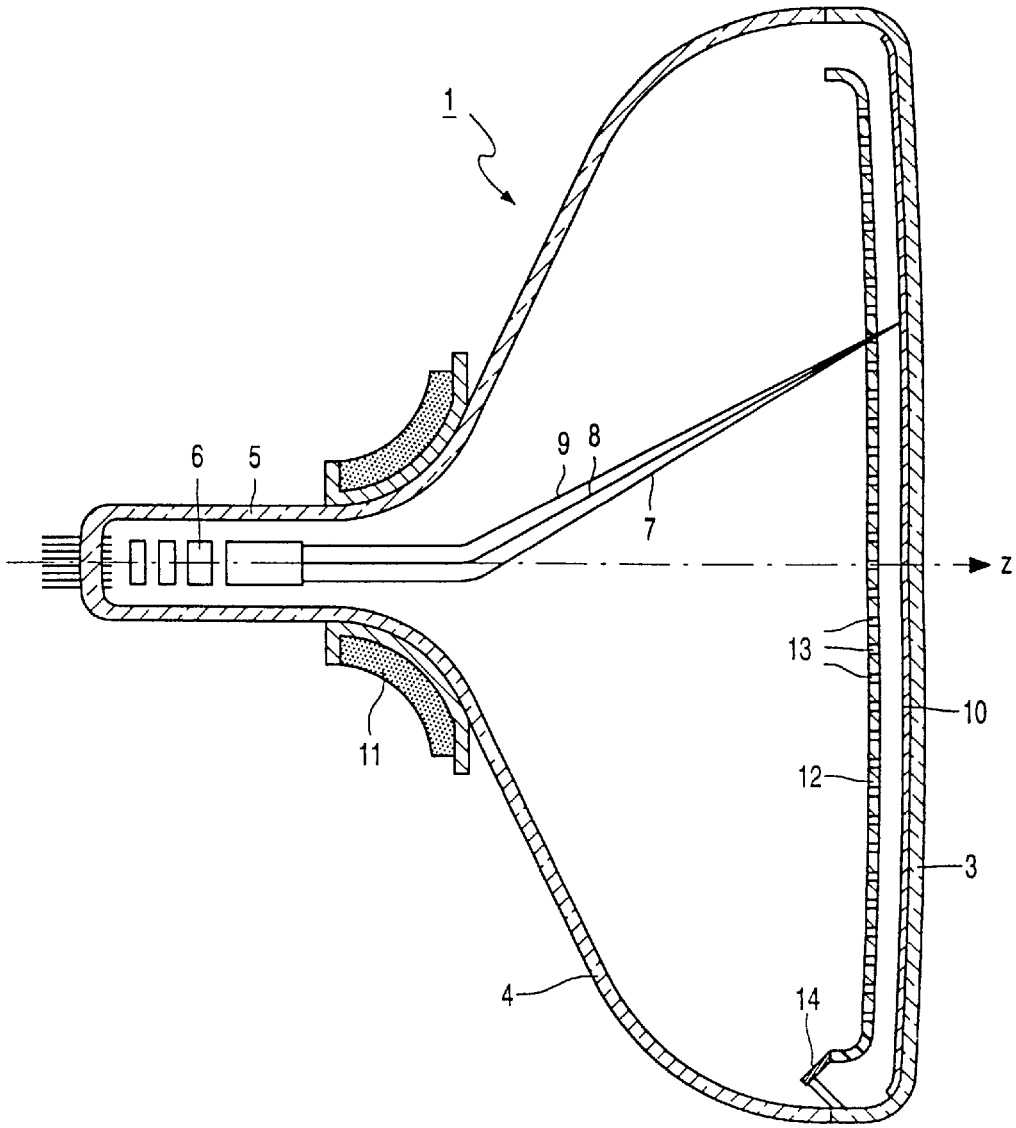

A colour display device 1 (FIG. 1) includes an evacuated envelope 2 comprising a display window 3, a cone portion 4 and a neck 5. In said neck 5 there is provided an electron gun 6 for generating three electron beams 7, 8 and 9. A display screen 10 is present on the inside of the display window. Said display screen 10 comprises a phosphor pattern of phosphor elements luminescing in red, green and blue. On their way to the display screen the electron beams 7, 8 and 9 are deflected across the display screen 10 by means of a deflection unit 11 and pass through a shadow mask 12 which is arranged in front of the display window 3 and which comprises a thin plate having apertures 13. The shadow mask is suspended in the display window by means of suspension means 14. The three electron beams converge and pass through the apertures of the shadow mask at a small angle with respect to each other and, consequently, each electron beam impinges on phosphor elements of only one colour. In FIG. 1 the axis (z-axis) of the envelope is also indicated.

The earth's magnetic field disturbs the image displayed on the display screen 10. The axial component of the earth's magnetic field causes a rotation of the image displayed (frame rotation). In addition, the vertical component of the earth's magnetic field adversely affects the shape of displayed image, more in particular causes a trapezoidal distortion of the displayed image. Coils are known to compensate for the rotation but not or hardly for the trapezoidal distortion.

Figure 2:
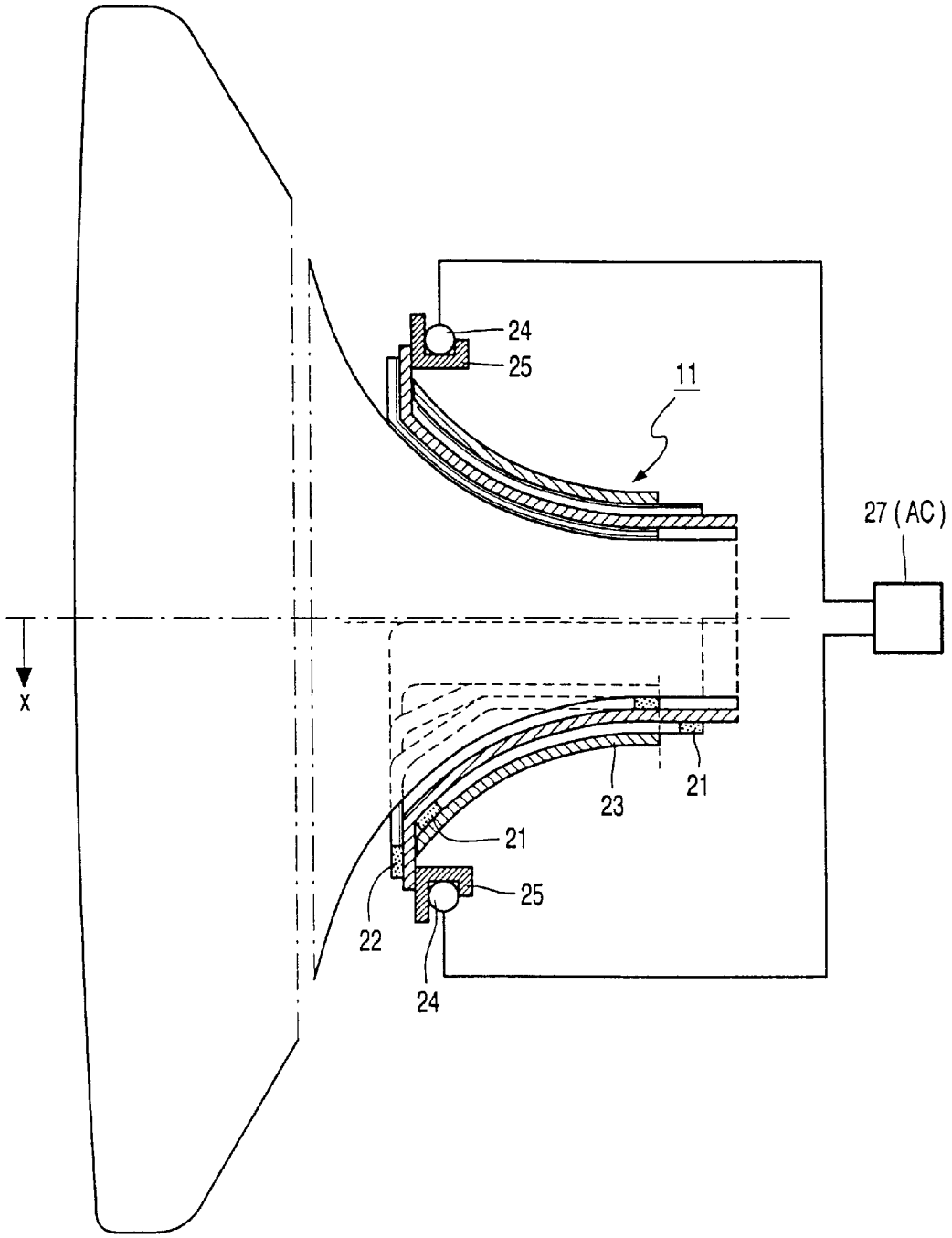
FIGS. 2 and 3 are sectional views of a deflection unit comprising a compensation coil.

FIG. 2 is a sectional view of a deflection unit in accordance with the invention. Said deflection unit comprises two deflection coil systems 21 and 22 for deflecting the electron beams in two mutually perpendicular directions. Coil system 21 comprises coils for the vertical deflection (deflection with relatively low frequency) of the electron beams. In this example, the deflection unit further comprises a yoke 23. Said yoke is made of soft-magnetic material. A compensation coil 24 is arranged circumferentially around the display device, in this example on the deflection unit 11. In this example, compensation coil 24 is fitted into a holder 25. Means 27 are provided to supply coil 24, in operation a dc current with the same frequency as the vertical deflection current.

It will be obvious that many variations are possible within the scope of the invention.

A preferred embodiment is, for example, formed by a display device comprising means for adjusting the position of the coil relative to the yoke. The coil may for example be fitted into a holder whose position can be adjusted. In particular the adjustment in the axial direction (z direction) is important. By virtue thereof, the compensation coil(s) can be adjusted so that the optimum position is obtained. However, the compensation coil(s) may alternatively be secured directly on the yoke. To this end, the yoke may comprise securing means (for example hooks). This is a simple construction. Preferably the coil is provided in a coil holder, such a holder provides some protection for the coil.

Figure 3:
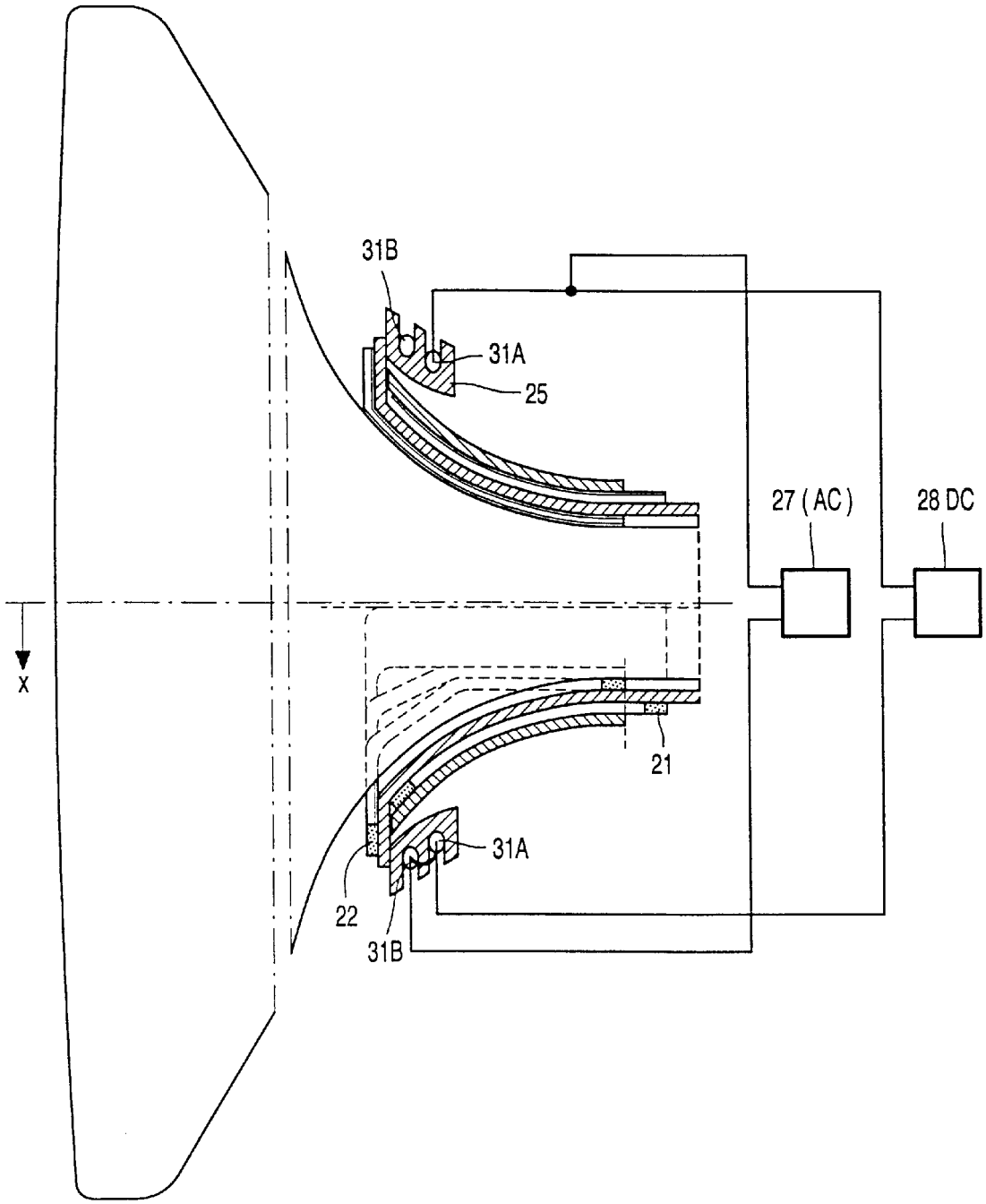

In its simplest form, the compensation coil is ring-shaped, the axial axis of the coil at least substantially coinciding with the axial axis of the envelope. However, the invention is not limited thereto. The coil may be composed of two or more sub-coils arranged in series. FIG. 3 shows such an embodiment. The display device comprises a compensation coil 31 including two sub-coils 31*a* and 31*b*. As explained below, one of these sub-coils may be supplied with ac current, while the other is supplied with ac and dc current.

The display device preferably comprises means for applying an adjustable voltage to the compensation coil or, if the compensation coil includes a plurality of sub-coils, for applying adjustable voltages to said sub-coils. By virtue thereof, the compensating effect of the coil can be adapted to the prevailing earth's magnetic field.

Figure 4:
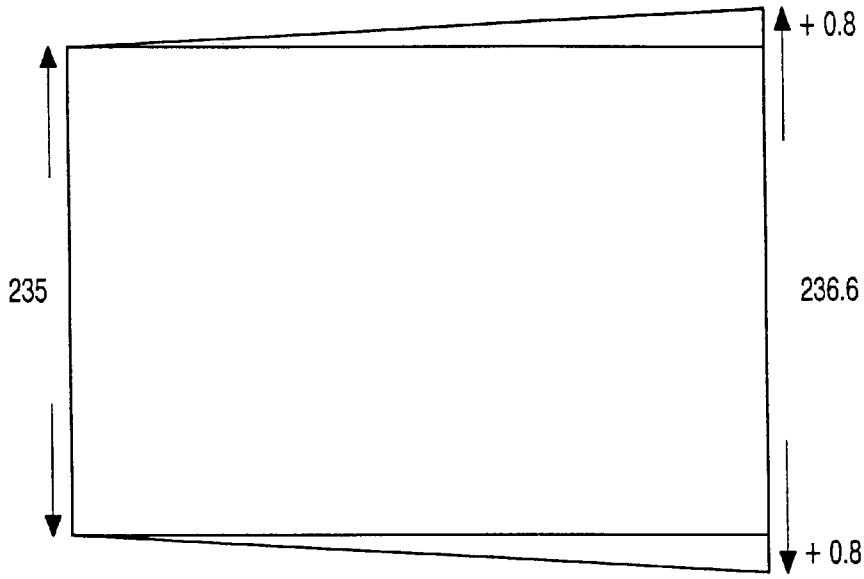
FIG. 4 illustrates the effect of the vertical component of the earth's magnetic field on the shape of the image displayed.

FIG. 4 illustrates the difference in the raster shape between the Northern and Southern hemisphere. When a device is optimised for the Northern hemisphere, which means usually more or less for the greater population centers (Japan, China, US, Europe, Southern Canada which are all situated between (roughly) 30 and 50 degrees northern latitude) the raster is rectangular as shown in the inner rectangular raster in FIG. 4. However, for the major centers of population on the Southern hemisphere a trapezoidal distortion is apparent, of typically 1.6 mm for a 17" diagonal display device. In FIG. 4 this is shown by means of the trapezoidal distorted shape. Such a distortion reduces the image quality and may lead to rejection of the device.

FIGS. 5A and 5B show schematically the rotation of the raster (R, FIG. 5A) and trapezoidal distortion (T, FIG. 5B) caused by an ambient field such as the earth's magnetic field, also indicated are the required current (I) through a circumferentially arranged coil to generate compensating magnetic fields, + means positive, – means negative. To correct for the trapezoidal distortion the following current should be supplied:

| part of the screen | rotation needed | current needed |
|---|---|---|
| upper | positive | positive (+) |
| centre | zero | zero (0) |
| lower | negative | negative (–) |

Thus, supplying an ac current to the coil in correspondence with the above scheme will counteract the trapezoidal distortion. The amount of current needed depends on the number of turns of the coil, the dimension and position of the coil, but can easily be found either experimentally or by means of calculations or a combination of both. The required current is available as the vertical deflection current, which means that the correction coil can be connected in series with the vertical deflection coil. An example of such an arrangement is schematically shown in FIG. 5C. The number is preferably between 5–20 in such an arrangement, when the coil is arranged at or near the screen facing end of the deflection unit. The added impedance to the vertical coils is neglectably small. Therefore there are no problems when using this solution in standard devices. Based on the same principle alternative and in circumstances preferred embodiments are formed by for instance:

Instead of a coil mounted on the deflection unit, a standalone coil on the cone of the tube. This could for instance be advantageous when the solution is to be used on a already existing device.

Instead of switching in series with the vertical deflection coils, a specialised circuitry can be used that generates a similar wave form. By making the amplitude and polarity variable, the amount of trapezium correction can be adjusted.

The amount of current through the correction coil 24 can be very simply adjusted by arranging an adjustable impedance 24A in parallel (FIG. 5D). Of course a more elaborate scheme of adjusting may be used. The setting of the current may be done by the manufacturer or, alternatively the means for setting may have several settings which can be set by users, such settings corresponding to for instance a southern latitude or a country.

Instead of supplying correction coil 24 with only dc current, it could also be supplied with an ac current to counteract image rotation (see FIG. 5A). A simplified scheme for such an arrangement is shown in FIG. 6. It is remarked that in such an embodiment the number of turns of the coil 24 is preferably higher, in the range 100–400. FIG. 6 show very schematically a scheme for driving such a coil 24. Dedicated, more complex circuitry could be used to drive the coil 24. The advantage of such an embodiment is that one coil is used to combine both rotation and trapezium correction.

FIG. 7 shows an embodiment corresponding to the embodiment shown in FIG. 3 in which two coils 31A and 31B are used. Coil 31B is driven by AC and DC current and correct the trapezium distortion and part of the rotation distortion. Coil 31B has preferably a limited number of turns (5–20). Coil 31A is driven by dc current and compensate a (mayor) part of the rotation error. This coil preferably has a larger number of turns (100–400). A switch 35 could be provided.

It will be clear that, within the scope of the invention, many more variations are possible for those skilled in the art.

What is claimed is:

1. A colour display device comprising a cathode ray tube, a means for generating at least one electron beam(s), a display screen and a deflection unit for generating deflection fields for deflecting the electron beam(s) across the display screen, characterised in that the display device comprises a coil (24, 31B) circumferentially arranged around the display device and the display device comprises means (27) for directing an ac current through the coil, said ac current having the same frequency as the vertical deflection current for generating a magnetic field for compensation of a trapezium shaped distortion of the displayed image.

2. Colour display device as claimed in claim 1, characterised in that the coil is arranged at, near or beyond the end of the deflection unit (11) facing the display screen.

3. Colour display device as claimed in claim 2, characterised in that the coil is mounted on the deflection unit.

4. Colour display device as claimed in claim 1, characterised in that the display device is provided with means (28) to supply also a dc current to the coil.

5. Colour display device as claimed in claim 1, characterised in that the coil is arranged in series with the vertical deflection coils (21).

6. Colour display device as claimed in claim 5, characterised in that the coil (24, 31B) comprises 5–20 turns.

7. Colour display device as claimed in claim 4, characterised in that the coil (24) comprises 100–400 turns.

8. Colour display device as claimed in claim 4, characterised in that the coil is arranged in series with a second coil (31A) circumferentially arranged around the tube through which, in operation, the dc current is lead.

* * * * *